US009080229B2

(12) United States Patent
Dehoff et al.

(10) Patent No.: US 9,080,229 B2
(45) Date of Patent: Jul. 14, 2015

(54) NANO-COMPOSITE STAINLESS STEEL

(75) Inventors: Ryan R. Dehoff, Knoxville, TN (US); Craig A. Blue, Knoxville, TN (US); William H. Peter, Knoxville, TN (US); Wei Chen, Oak Ridge, TN (US); Louis F. Aprigliano, Berlin, MD (US)

(73) Assignee: UT-Battelle, LLC, Oak Ridge, TN (US)

( * ) Notice: Subject to any disclaimer, the term of this patent is extended or adjusted under 35 U.S.C. 154(b) by 715 days.

(21) Appl. No.: 13/465,360

(22) Filed: May 7, 2012

(65) Prior Publication Data

US 2013/0294966 A1 Nov. 7, 2013

(51) Int. Cl.

| | |
|---|---|
| ***C22C 38/44*** | (2006.01) |
| ***C22C 38/54*** | (2006.01) |
| ***C22C 30/00*** | (2006.01) |
| ***C22C 38/18*** | (2006.01) |
| ***C22C 38/40*** | (2006.01) |
| ***C22C 38/58*** | (2006.01) |
| ***C22C 33/02*** | (2006.01) |

(52) U.S. Cl.

CPC ..... *C22C 30/00* (2013.01); *C22C 33/0285* (2013.01); *C22C 38/18* (2013.01); *C22C 38/40* (2013.01); *C22C 38/44* (2013.01); *C22C 38/54* (2013.01); *C22C 38/58* (2013.01)

(58) Field of Classification Search

None

See application file for complete search history.

(56) References Cited

U.S. PATENT DOCUMENTS

| | | | | |
|---|---|---|---|---|
| 4,576,653 | A * | 3/1986 | Ray | 419/61 |
| 7,662,207 | B2 | 2/2010 | Miura et al. | |
| 7,785,428 | B2 | 8/2010 | Branagan | |
| 7,939,142 | B2 | 5/2011 | Blue et al. | |
| 2009/0025834 | A1 | 1/2009 | Poon et al. | |
| 2010/0154942 | A1 | 6/2010 | Branagan et al. | |

FOREIGN PATENT DOCUMENTS

| | | | |
|---|---|---|---|
| CN | 1121854 | A | 5/1996 |
| CN | 101974724 | A | 2/2011 |
| JP | 2006274323 | | 10/2006 |
| JP | 2009114471 | A | 5/2009 |
| WO | 9102101 | | 2/1991 |

OTHER PUBLICATIONS

Henderson, et al., Phases and Magnetic Properties of the Devitrified Metallic Glasses Co66Cr14B20 and Fe43Cr25Ni20B12, Journal of Magnetism and Magnetic Materials, p. 142-142 (1990).

Day, et al., Effect of High Temperature Aging on the Corrosion Resistance of Iron Based Amorphous Alloys, Materials Science and Technology Conference, (2007).

* cited by examiner

*Primary Examiner* — Deborah Yee

(74) *Attorney, Agent, or Firm* — Joseph A. Marasco

(57) ABSTRACT

A composite stainless steel composition is composed essentially of, in terms of wt. % ranges: 25 to 28 Cr; 11 to 13 Ni; 7 to 8 W; 3.5 to 4 Mo; 3 to 3.5 B; 2 to 2.5 Mn; 1 to 1.5 Si; 0.3 to 1.7 C; up to 2 O; balance Fe. The composition has an austenitic matrix phase and a particulate, crystalline dispersed phase.

15 Claims, 10 Drawing Sheets

NANO-COMPOSITE STAINLESS STEEL

STATEMENT REGARDING FEDERALLY SPONSORED RESEARCH

The United States Government has rights in this invention pursuant to contract no. DE-AC05-00OR22725 between the United States Department of Energy and UT-Battelle, LLC.

CROSS-REFERENCE TO RELATED APPLICATIONS

None

NAMES OF PARTIES TO A JOINT RESEARCH AGREEMENT

UT-Battelle, LLC, P.O. Box 2008, Oak Ridge, Tenn. 37831 and Strategic Analysis, Inc., 3601 Wilson Blvd Suite 500, Arlington, Va., 22201.

BACKGROUND OF THE INVENTION

It is not possible by conventionally metallurgical processing (e.g. the mixing of borides and carbides into molten steel) to produce stainless steel alloys with high volume fractions of complex metal boron-carbides (CMBCs). Therefore, stainless steel based materials are typically softer and have inferior mechanical properties than non-stainless steels, e.g. tool steels.

U.S. Pat. No. 7,939,142 issued on May 10, 2011 to Blue, et al. entitled "In-Situ Composite Formation of Damage Tolerant Coatings Utilizing Laser" describes Fe-based amorphous compositions that are suitable for application as coatings on steel components. As long as the material remains in the amorphous state, it has superior corrosion resistance while maintaining excellent hardness that is especially desired under high wear applications. However, because amorphous materials are metastable by nature, the material eventually crystallizes, resulting in a decrease in corrosion resistance.

Previous research at Oak Ridge National Laboratory (ORNL) has shown that several compositions based on SAM 1651 and SAM 2×5 (described in U.S. Pat. No. 7,939,142) can be laser-fused to plain tool steel to increase the surface hardness and mitigate wear. Such coatings are beneficial to high wear applications where extended component lifetimes are not expected and under environments, which are not generally corrosive. However, for drilling operations such as those observed in geothermal applications, the corrosive environment has a severely pernicious effect on the coating integrity.

BRIEF SUMMARY OF THE INVENTION

In accordance with examples of the present invention, the foregoing and other objects are achieved by a composite stainless steel composition that is composed essentially of, in terms of wt. % ranges: 25 to 28 Cr; 11 to 13 Ni; 7 to 8 W; 3.5 to 4 Mo; 3 to 3.5 B; 2 to 2.5 Mn; 1 to 1.5 Si; 0.3 to 1.7 C; up to 2 O; balance Fe. The composition has an austenitic matrix phase and a particulate, crystalline dispersed phase.

Figure 1:
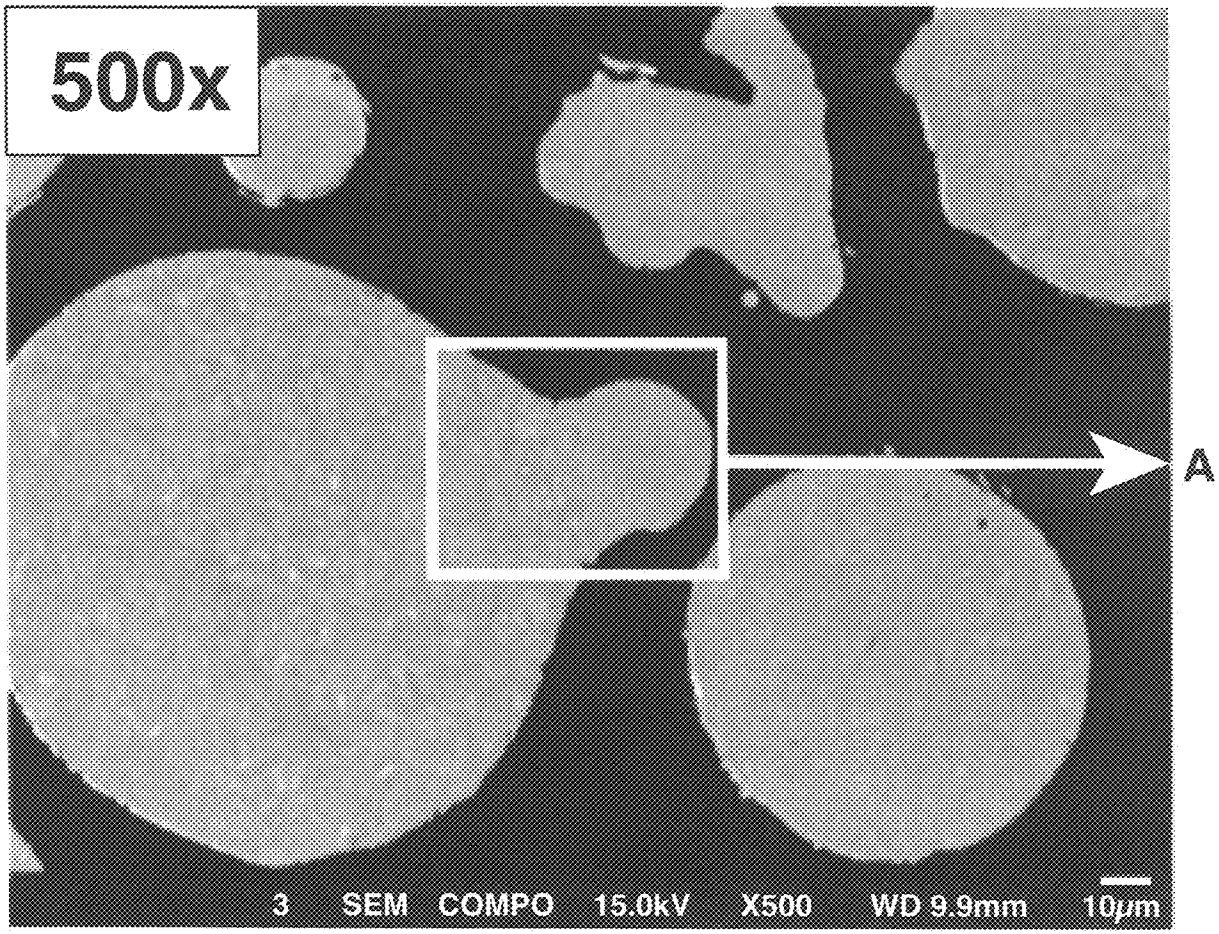
FIG. 1 is a backscattered electron micrograph showing the cross section of a gas atomized powder in accordance with examples of the present invention.

For a better understanding of the present invention, together with other and further objects, advantages and capabilities thereof, reference is made to the following disclosure and appended claims in connection with the above-described drawings.

DETAILED DESCRIPTION OF THE INVENTION

The present invention is a new Fe based austenitic stainless steel alloy that at least partially devitrifies upon laser fusing or bulk processing, forming a dispersion of nano to sub-micron particles that can include complex carbides, borides, borocarbides, and oxides. Some of the particles can be present within the matrix phase, some can be surrounded by the matrix phase, and some can be formed on the grain boundaries of the matrix phase. The alloy is characterized by high hardness, wear resistance, and corrosion resistance.

In accordance with examples the present invention, a composite stainless steel composition is composed essentially of, in terms of wt. % ranges: 25 to 28 Cr; 11 to 13 Ni; 7 to 8 W; 3.5 to 4 Mo; 3 to 3.5 B; 2 to 2.5 Mn; 1 to 1.5 Si; 0.3 to 1.7 C; up to 2 O; balance Fe. Further in accordance with examples the present invention, a composite stainless steel composition can be composed essentially of, in terms of wt. % ranges: 25.5 to 27.5 Cr; 11.5 to 12.5 Ni; 7.2 to 7.8 W; 3.6 to 4.0 Mo; 3.0 to 3.37 B; 2 to 2.4 Mn; 1 to 1.5 Si; 0.3 to 1.7 C; up to 2 O; and balance Fe. Further in accordance with examples the present invention, a composite stainless steel composition can be composed essentially of, in terms of wt. %: 43.1 Fe-27.1 Cr-11.5 Ni-7.5 W-3.7 Mo-3.1 B-2.1 Mn-1.4 Si-0.49 C 0.01 O. Further in accordance with examples the present invention, a composite stainless steel composition can be composed essentially of, in terms of wt. %: 44.39 Fe-25.83 Cr-11.65 Ni-7.31 W-3.81 Mo-3.22 B-2.18 Mn-1.12 Si-0.48 C-0.01 O. Further in accordance with examples the present invention, a composite stainless steel composition can be composed essentially of, in terms of wt. %: 41.39 Fe-26.76 Cr-12.09 Ni-7.57 W-3.95 Mo-3.34 B-2.26 Mn-1.16 Si-1.48 C-0.01 O.

The composition has an austenitic matrix phase and a particulate, crystalline dispersed phase. The austenitic matrix phase is least partly devitrified, and the particulate, crystalline dispersed phase of metal carbides, metal borides, metal carboborides, and metal oxides.

The composition is characterized by at least one of the following measurable characteristics: hardness of 1000 HV, compressive strength of at least 100,000 PSI, and corrosion resistance at least equal to that of 316 stainless steel.

General steps for making the compositions via gas-atomization are as follows: Melt the elements in an induction furnace. Pour molten metal through a nozzle to form a molten stream. Disrupt the molten stream with pressurized argon or nitrogen gas to form molten droplets. The droplets are allowed to solidify into generally spherical particles (powder).

Example I

In accordance with examples the present invention, alloy 43.1 Fe-27.1 Cr-11.5 Ni-7.5 W-3.7 Mo-3.1 B-2.1 Mn-1.4 Si-0.49 C -0.01 O was gas-atomized on a full-scale production gas atomization furnace using argon gas using the general steps described hereinabove.

Figure 2:
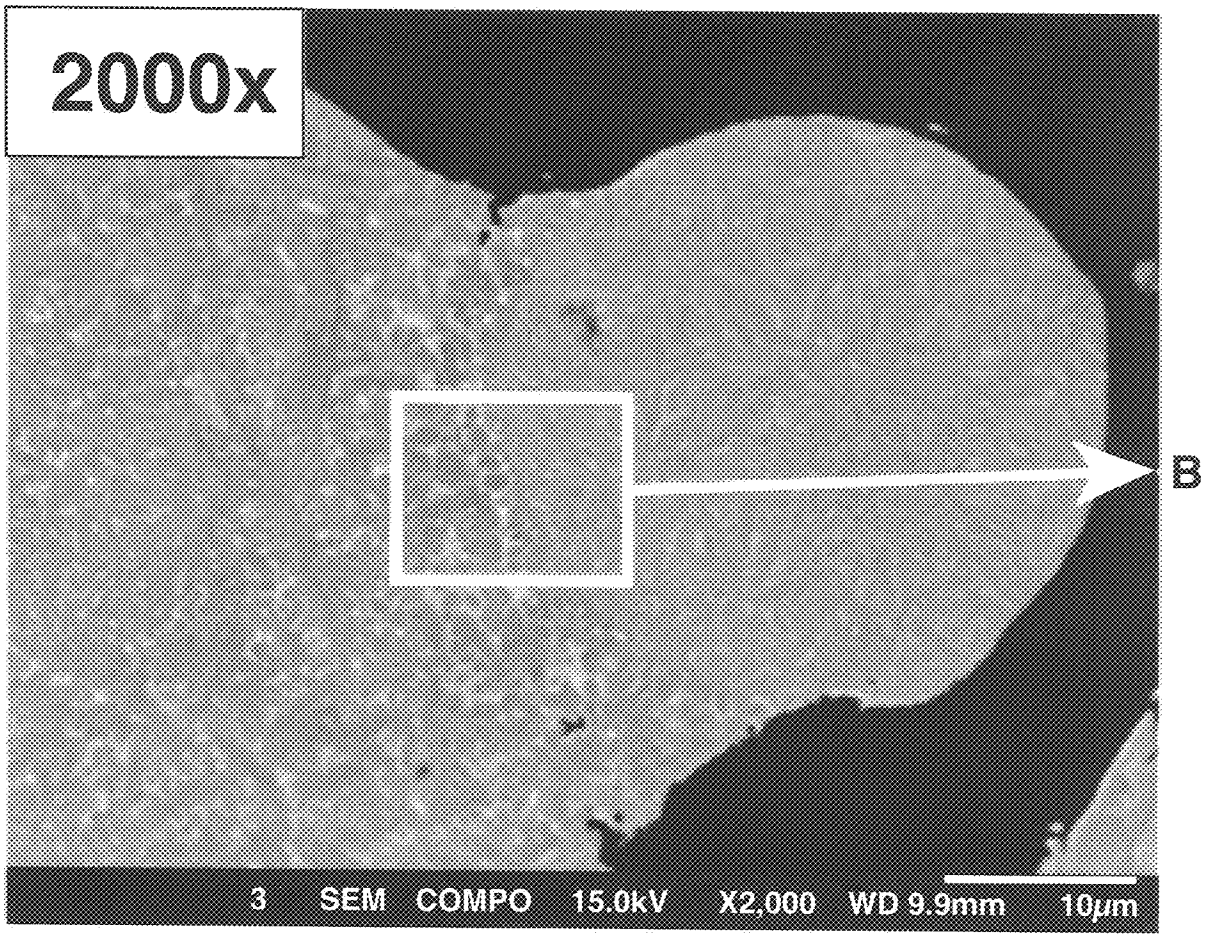
FIG. 2 is a further magnified image of inset A of FIG. 1.
Figure 3:
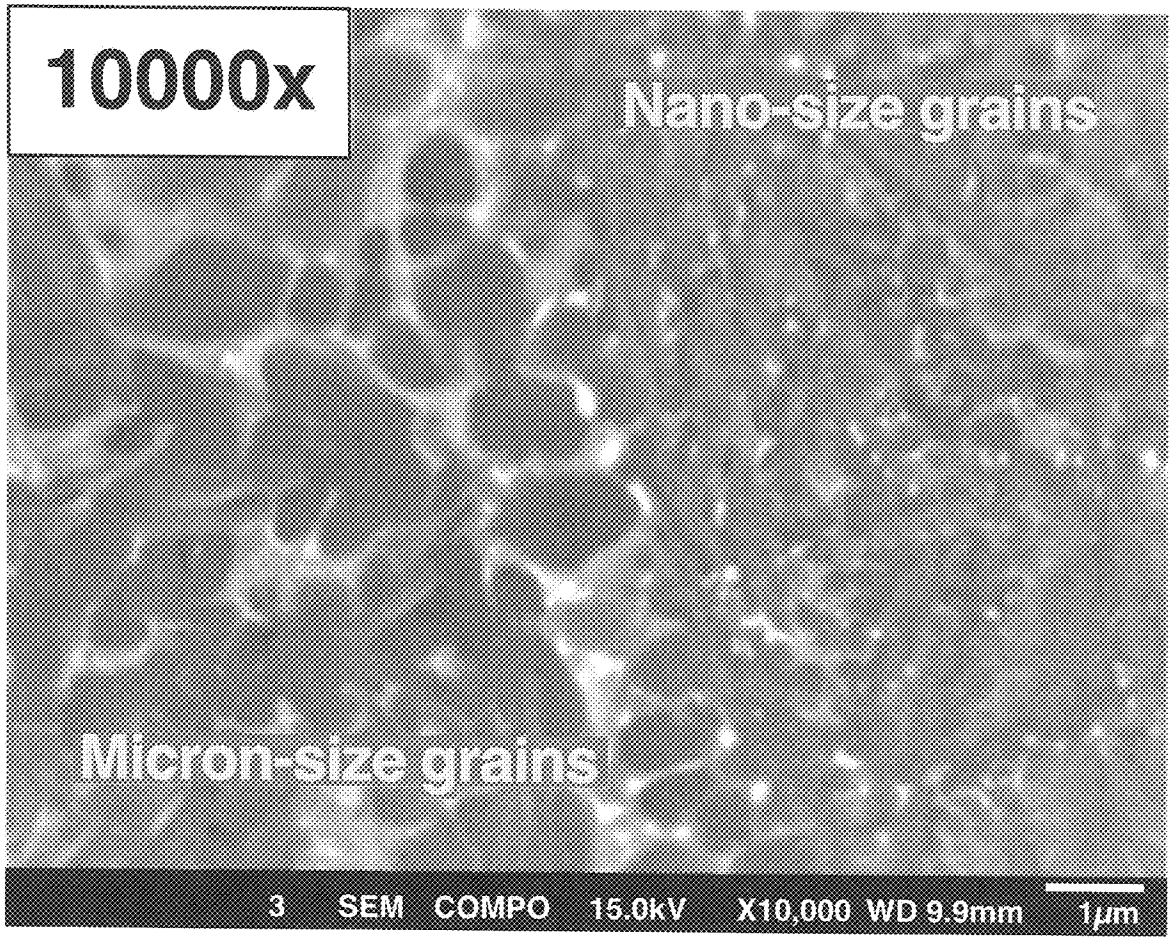
FIG. 3 is a further magnified image of inset B of FIG. 2.
Figure 4:
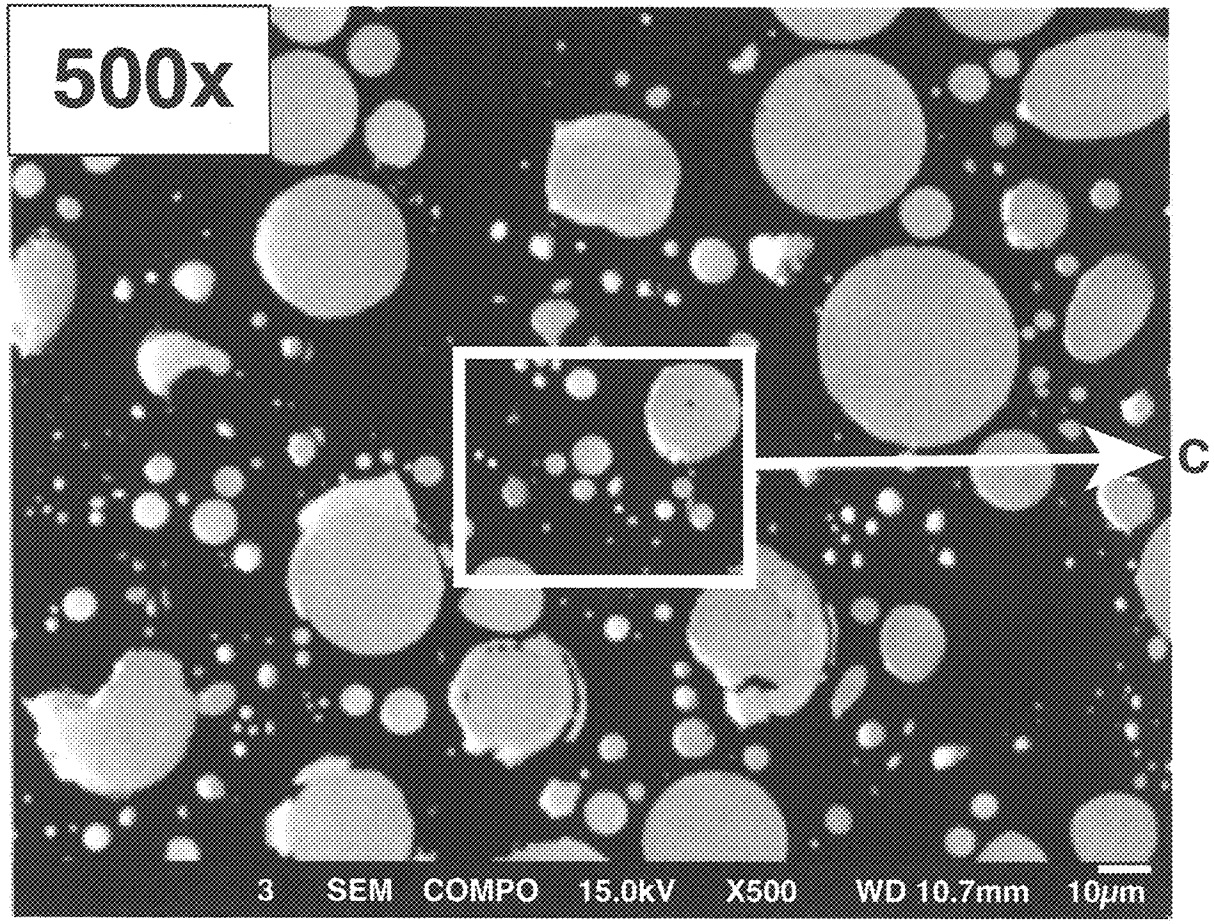
FIG. 4 is a backscattered electron micrograph showing the cross section of a gas atomized powder in accordance with examples of the present invention.
Figure 5:
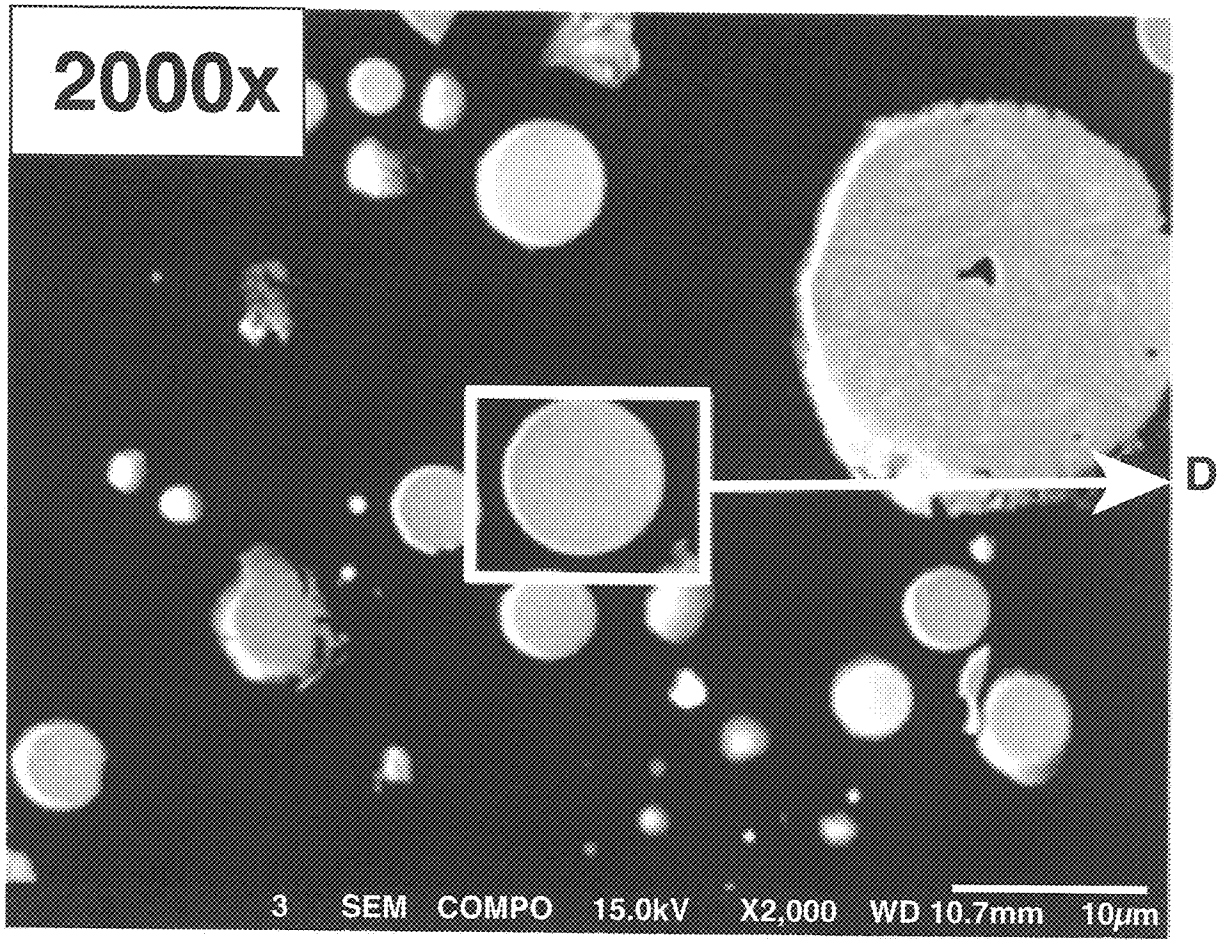
FIG. 5 is a further magnified image of inset C of FIG. 4.
Figure 6:
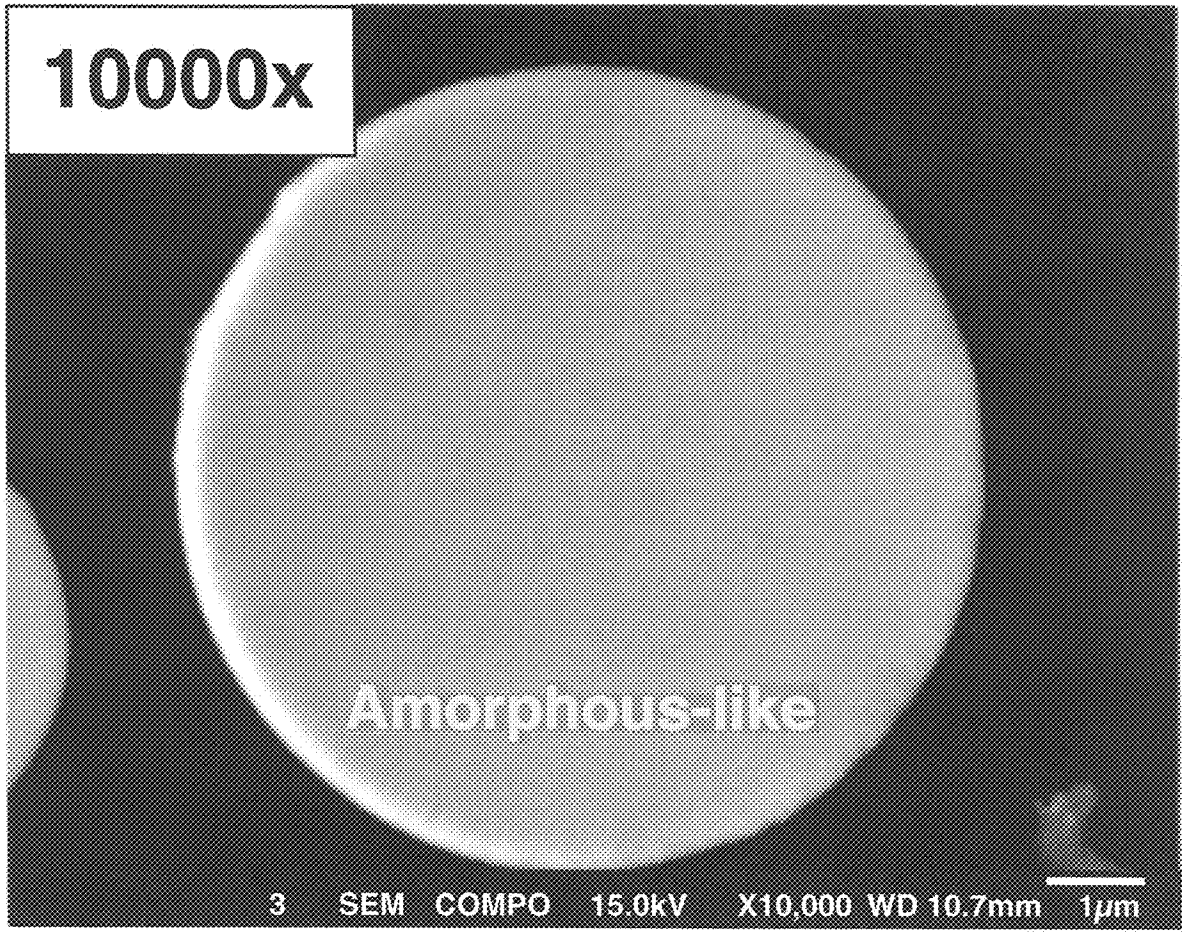
FIG. 6 is a further magnified image of inset D of FIG. 5.

Because the composition is glassy in nature and the cooling rates associated with the gas atomization process are rapid, the powder remains in the amorphous state for small powder sizes and is nanocrystalline for larger powder sizes. The powder was sieved to ±325 mesh and polished, and analyzed by SEM-BSE to produce the micrographs shown in FIGS. 1-6. FIGS. 1-3 show, at various magnifications, particles having micron-size grains and/or nano-size grains. FIGS. 4-6 show, at various magnifications, a particle having amorphous-like structure.

Gas-atomized compositions as described herein can be applied as a coating to various metallic surfaces by various means, including laser fusion. Upon focusing of a laser beam, for example from an Nd YAG laser, onto a steel surface to which an the powder has been deposited via aspiration or other suitable means, the powder and some substrate melt. Upon removal of the laser beam, the liquid alloy rapidly cools to form the amorphous, partially devitrified, or fully devitrified alloy feature. The steel substrate acts as a heat sink to remove heat rapidly from the substrate side of the feature. The top surface can be cooled by an impinging inert gas. The rapid cooling permits the tungsten, boron, chromium, molybdenum and carbon to precipitate as complex metal carbides, metal borides, or metal carboborides in an amorphous, partially devitrified or fully devitrified ferrite matrix that is metallurgically bonded to the steel substrate.

Example II

In accordance with examples the present invention, samples of material made in accordance with Example I above was laser fused using a Nd YAG laser. Power levels were 2000 to 4000 watts, coating thicknesses were 150 to 400 micrometers, substrate pre-heats of none and 400° C. were used, travel speeds of 1250 to 1500 millimeters per minute were used, and cover gases of argon and nitrogen were used.

Gas-atomized compositions as described herein can be bulk consolidated using a variety of processes including vacuum hot pressing (VHP), the Dynaforge Process (Carpenter Powder Products, 600 Mayer Street , Bridgeville, Pa. 15017) and hot isostatic pressing (HIP).

Example III

Figure 7:
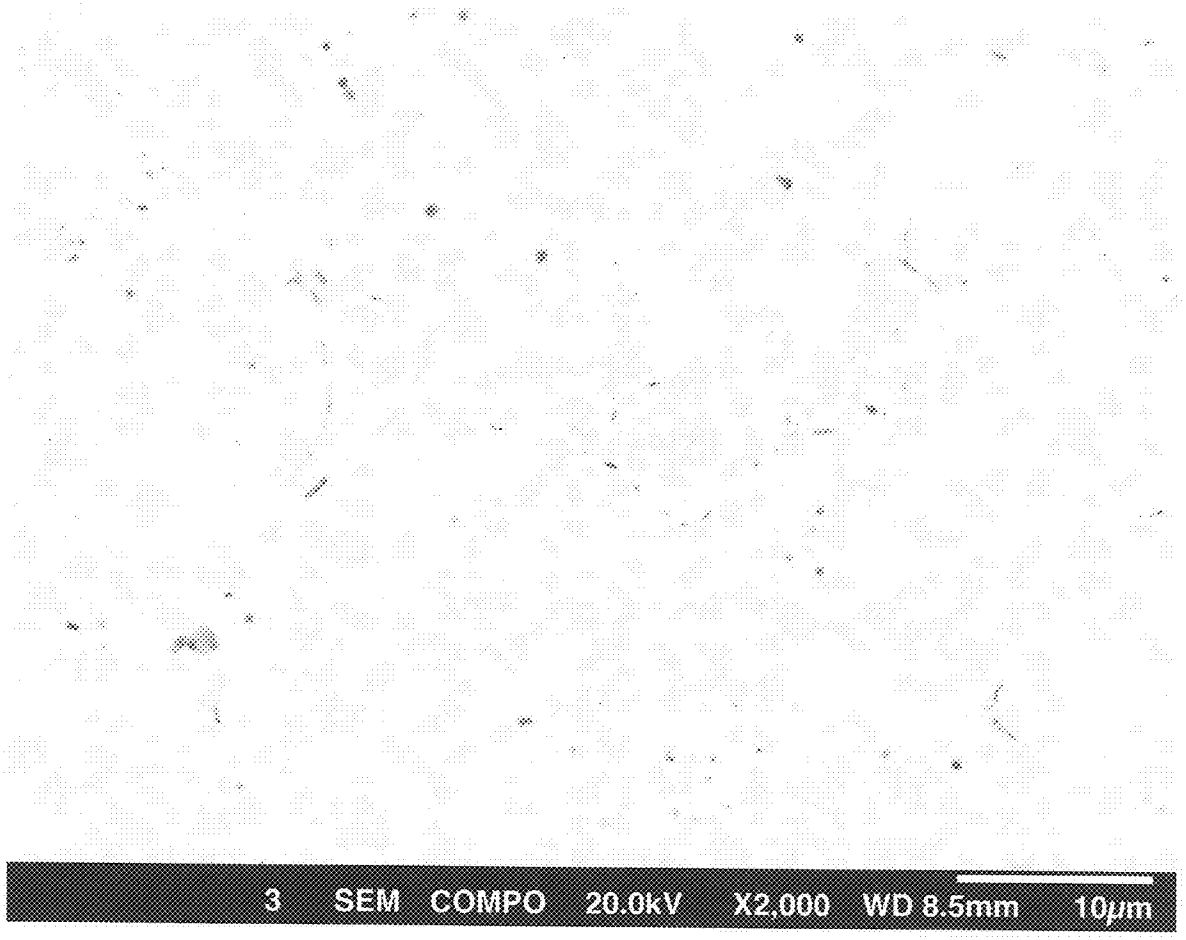
FIG. 7 is a backscattered electron micrograph showing the cross section of a gas atomized powder that has been subjected to hot-isostatic-pressing at 1950° F. in accordance with examples of the present invention.

In accordance with examples the present invention, a sample of material made in accordance with Example I above was bulk-consolidated by HIP at 1950° F. for 4 hours. Resulting microstructure is shown in FIG. 7.

Example IV

Figure 8:
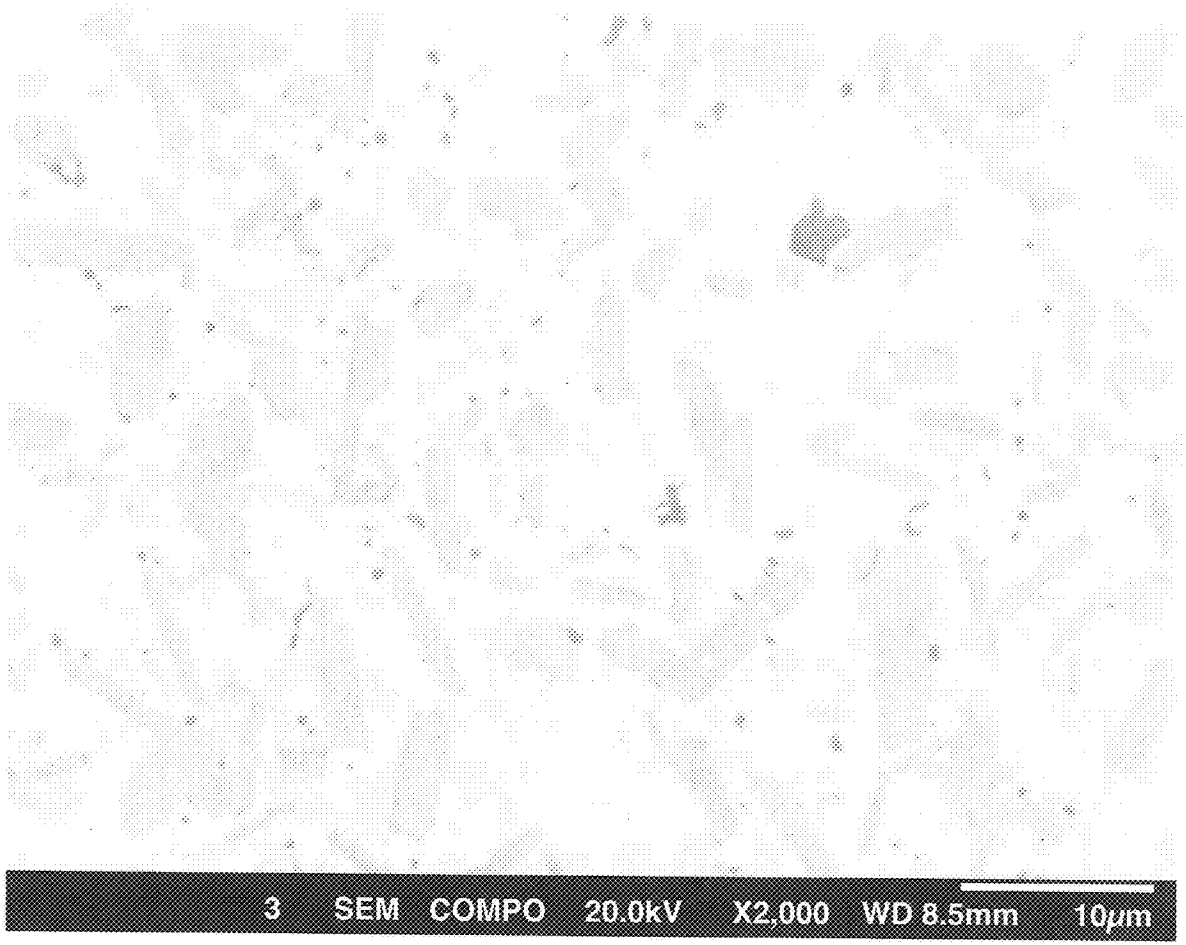
FIG. 8 is a backscattered electron micrograph showing the cross section of a gas atomized powder that has been subjected to hot-isostatic-pressing at 2125° F. in accordance with examples of the present invention.

In accordance with examples the present invention, a sample of material made in accordance with Example I above was bulk-consolidated by HIP at 2125° F. for 4 hours. Resulting microstructure is shown in FIG. 8. There is some coarsening of the original particle size at the higher HIP temperature, but this does not appear to have a negative effect on material properties.

Example V

In accordance with examples the present invention, a sample of material made in accordance with Example I above was analyzed by X-ray diffraction to confirm the material formed various carbides and borides dispersed in an austenitic matrix. The austenitic matrix is consistent with what would be observed through conventionally processed stainless steel materials.

Example VI

Figure 10:
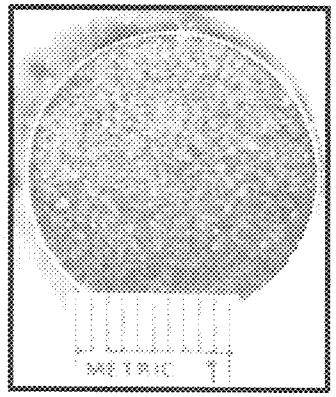
FIG. 10 is a photograph of the sample of FIG. 9 after testing.
Figure 9:
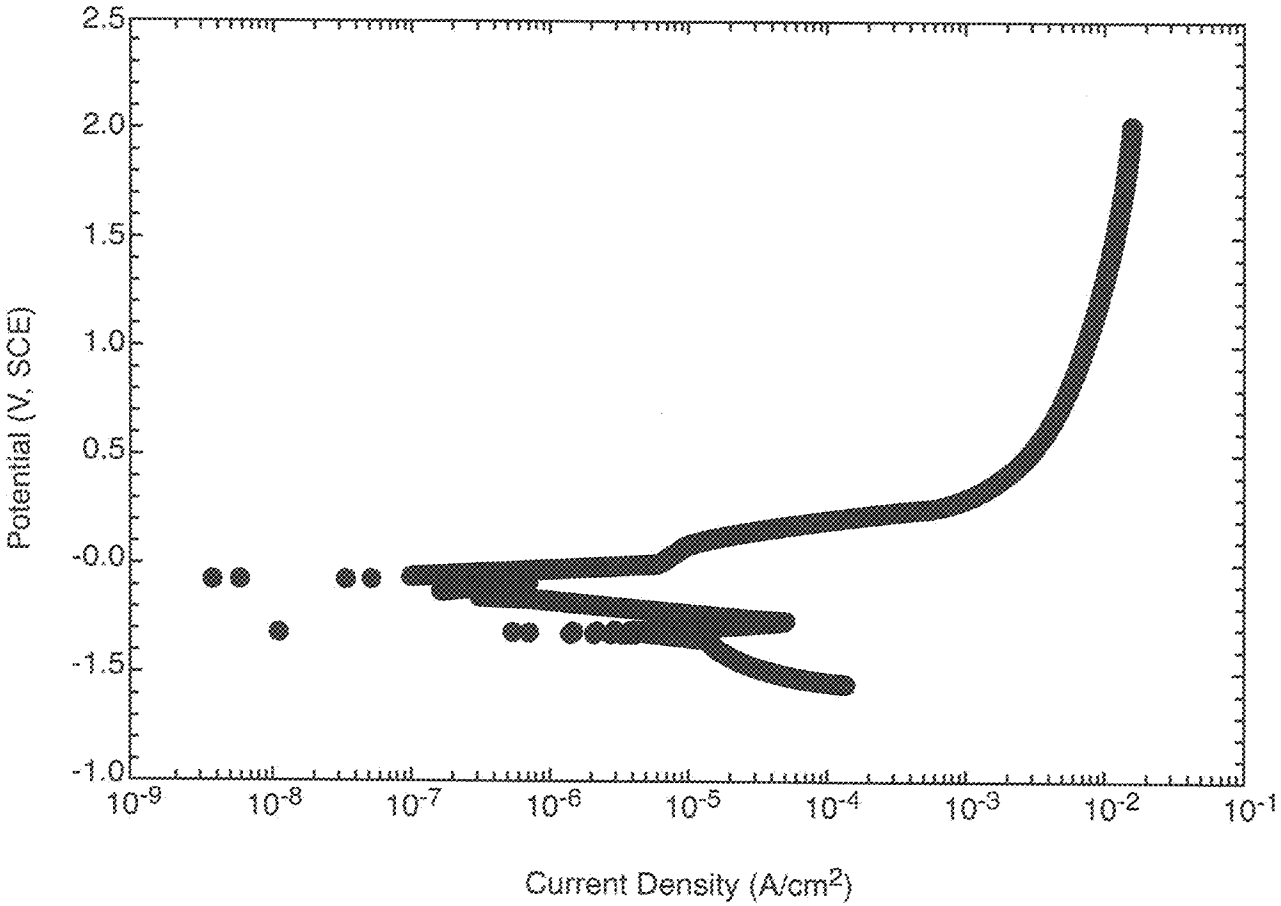
FIG. 9 is an electrochemical polarization curve of a test sample of a composition made in accordance with the present invention.
Figure 12:
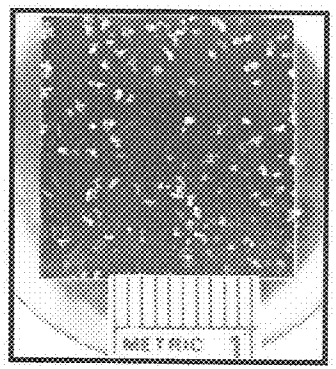
FIG. 12 is a photograph of the sample of FIG. 11 after testing.
Figure 11:
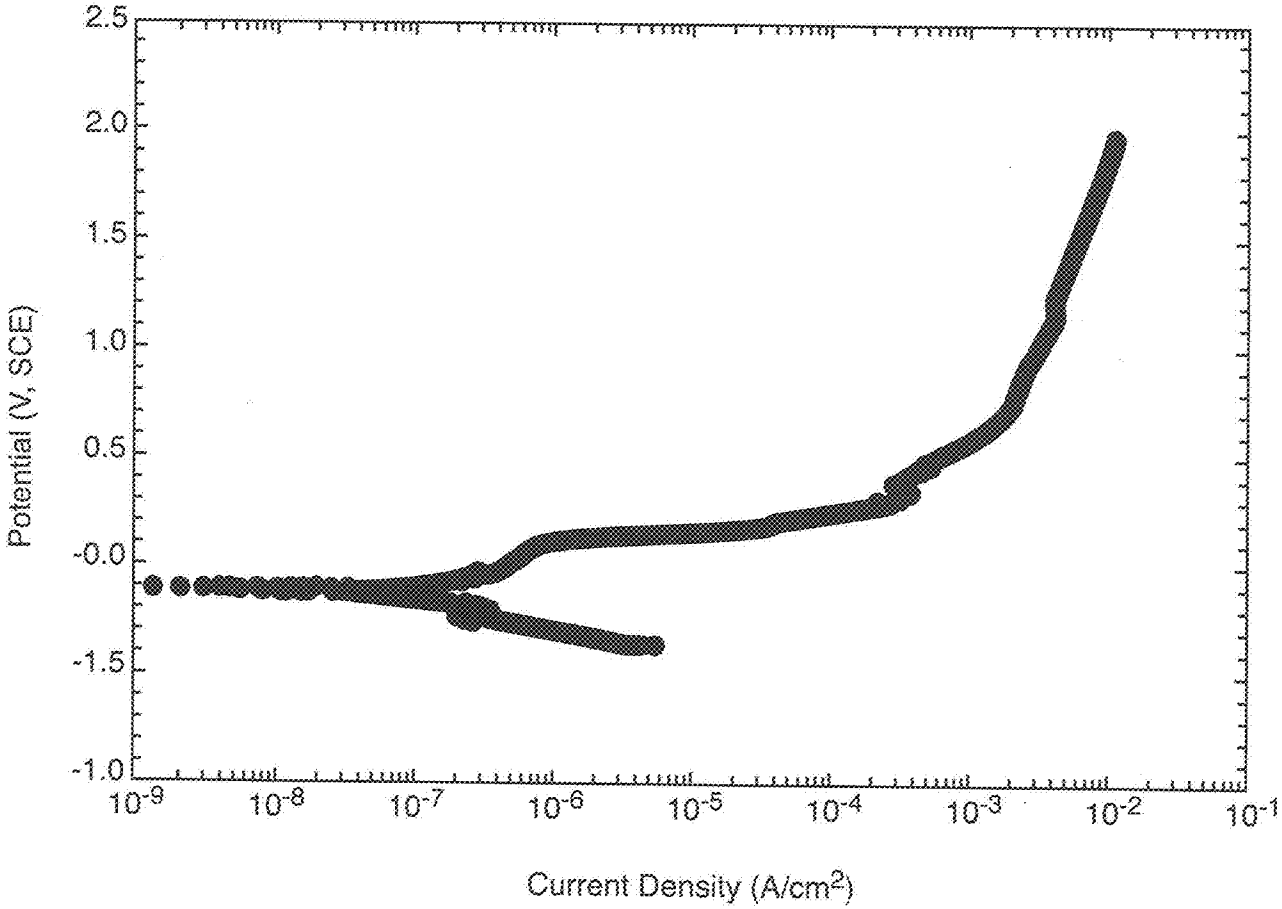
FIG. 11 is an electrochemical polarization curve of a test sample of 304 stainless steel.

In accordance with examples the present invention, a sample of material made in accordance with Example IV above was tested for corrosion resistance by electrochemical polarization and salt-fog testing. For the electrochemical polarization, samples were immersed in 5 wt. % NaCl at pH 2 using HCI at room temperature. 304 stainless steel was also tested for comparison purposes. The polarization curves were made by a potentiodynamic scan from −250 millivolts below open circuit to 2000 millivolts with respect to reference saturated calomel electrode. Respective polarization curves are shown in FIGS. 9, 11. Visual inspection showed that the composite stainless steel of the present invention exhibited better resistance to pitting than the 304 stainless steel under identical test conditions, as shown in respective FIGS. 10, 12. In FIG. 10, there is minor etching with no significant 3-dimensional relief. In FIG. 12, there is significant pitting; pits are up to 25 mm in width and 10-12 mm in depth.

For the salt fog testing, samples made in accordance with Example IV were exposed to two cycles that each consisted of a 2 minute misting with a sea water solution. They were then exposed for 4 hours to 100% relative humidity at approximately 120° F. After this they were then exposed for 2 hours to 30% or less humidity at approximately 140° F. Testing was stopped after only two cycles due to the extensive corrosion of the 4340 and H13 tool steel samples that were included in the salt fog test for reference purposes. The sample made in accordance with Example IV was corrosion free.

While there has been shown and described what are at present considered to be examples of the invention, it will be obvious to those skilled in the art that various changes and modifications can be prepared therein without departing from the scope of the inventions defined by the appended claims.

What is claimed is:

1. A composite stainless steel composition consisting essentially of, in terms of wt. % ranges: 25 to 28 Cr; 11 to 13 Ni; 7 to 8 W; 3.5 to 4 Mo; 3 to 3.5 B; 2 to 2.5 Mn; 1 to 1.5 Si; 0.3 to 1.7 C; up to 2 O; and balance Fe, said composite stainless steel composition having an austenitic matrix phase and a particulate, crystalline dispersed phase.

2. A composite stainless steel composition in accordance with claim 1 wherein said austenitic matrix phase is least partly devitrified, and wherein said particulate, crystalline dispersed phase comprises at least one material selected from the group consisting of metal carbides, metal borides, metal carboborides, and metal oxides.

3. A composite stainless steel composition in accordance with claim 1 wherein said composition is characterized by at least one characteristic selected from the group consisting of a hardness of 1000 HV, a compressive strength of at least 100,000 PSI, and a corrosion resistance at least equal to that of 316 stainless steel.

4. A composite stainless steel composition in accordance with claim 1 consisting essentially of, in terms of wt. % ranges: 25.5 to 27.5 Cr; 11.5 to 12.5 Ni; 7.2 to 7.8 W; 3.6 to 4.0 Mo; 3.0 to 3.37 B; 2 to 2.4 Mn; 1 to 1.5 Si; 0.3 to 1.7 C; up to 2 O; and balance Fe.

5. A composite stainless steel composition in accordance with claim 4 wherein said austenitic matrix phase is least partly devitrified, and wherein said particulate, crystalline dispersed phase comprises at least one material selected from the group consisting of metal carbides, metal borides, metal carboborides, and metal oxides.

6. A composite stainless steel composition in accordance with claim 4 wherein said composition is characterized by at least one characteristic selected from the group consisting of a hardness of 1000 HV, a compressive strength of at least 100,000 PSI, and a corrosion resistance at least equal to that of 316 stainless steel.

7. A composite stainless steel composition in accordance with claim 4 consisting essentially of: 43.1 Fe-27.1 Cr-11.5 Ni-7.5 W-3.7 Mo-3.1 B-2.1 Mn-1.4 Si-0.49 C -0.01 O.

8. A composite stainless steel composition in accordance with claim 7 wherein said austenitic matrix phase is least partly devitrified, and wherein said particulate, crystalline dispersed phase comprises at least one material selected from the group consisting of metal carbides, metal borides, metal carboborides, and metal oxides.

9. A composite stainless steel composition in accordance with claim 7 wherein said composition is characterized by at least one characteristic selected from the group consisting of a hardness of 1000 HV, a compressive strength of at least 100,000 PSI, and a corrosion resistance at least equal to that of 316 stainless steel.

10. A composite stainless steel composition in accordance with claim 4 consisting essentially of: 44.39 Fe-25.83 Cr-11.65 Ni-7.31 W-3.81 Mo-3.22 B-2.18 Mn-1.12 Si-0.48 C-0.01 O.

11. A composite stainless steel composition in accordance with claim 10 wherein said austenitic matrix phase is least partly devitrified, and wherein said particulate, crystalline dispersed phase comprises at least one material selected from the group consisting of metal carbides, metal borides, metal carboborides, and metal oxides.

12. A composite stainless steel composition in accordance with claim 10 wherein said composition is characterized by at least one characteristic selected from the group consisting of a hardness of 1000 HV, a compressive strength of at least 100,000 PSI, and a corrosion resistance at least equal to that of 316 stainless steel.

13. A composite stainless steel composition in accordance with claim 4 consisting essentially of: 41.39 Fe-26.76 Cr-12.09 Ni-7.57 W-3.95 Mo-3.34 B-2.26 Mn-1.16 Si-1.48 C-0.01 O.

14. A composite stainless steel composition in accordance with claim 13 wherein said austenitic matrix phase is least partly devitrified, and wherein said particulate, crystalline dispersed phase comprises at least one material selected from the group consisting of metal carbides, metal borides, metal carboborides, and metal oxides.

15. A composite stainless steel composition in accordance with claim 13 wherein said composition is characterized by at least one characteristic selected from the group consisting of a hardness of 1000 HV, a compressive strength of at least 100,000 PSI, and a corrosion resistance at least equal to that of 316 stainless steel.

* * * * *